US010002511B2

(12) United States Patent
Condon

(10) Patent No.: US 10,002,511 B2
(45) Date of Patent: Jun. 19, 2018

(54) WALKER ALERT DEVICE

(71) Applicant: Heather G. Condon, Winthrop, ME (US)

(72) Inventor: Heather G. Condon, Winthrop, ME (US)

( * ) Notice: Subject to any disclaimer, the term of this patent is extended or adjusted under 35 U.S.C. 154(b) by 212 days.

(21) Appl. No.: 14/955,863

(22) Filed: Dec. 1, 2015

(65) Prior Publication Data

US 2017/0154514 A1 Jun. 1, 2017

(51) Int. Cl.

| | |
|---|---|
| ***G08B 21/02*** | (2006.01) |
| ***G08B 21/18*** | (2006.01) |
| ***A61H 3/00*** | (2006.01) |

(52) U.S. Cl.

CPC ..... *G08B 21/0205* (2013.01); *A61H 3/00* (2013.01); *G08B 21/0288* (2013.01); *G08B 21/182* (2013.01); *A61H 2201/0184* (2013.01); *A61H 2201/5064* (2013.01)

(58) Field of Classification Search

CPC ..... G08B 21/02; G08B 21/0225; G08B 21/0288; G08B 21/182; A61H 3/00

See application file for complete search history.

(56) References Cited

U.S. PATENT DOCUMENTS

| | | | | |
|---|---|---|---|---|
| 7,654,275 | B2 | 2/2010 | Ewell et al. | |
| 8,453,662 | B2 | 6/2013 | Trout | |
| 8,810,407 | B1 | 8/2014 | Nolan et al. | |
| 2006/0090783 | A1* | 5/2006 | King-Fai | A45B 1/00 135/67 |
| 2011/0166753 | A1* | 7/2011 | Yu | A61H 3/04 701/51 |
| 2016/0299502 | A1* | 10/2016 | Chamberlain | G05D 1/0242 |

* cited by examiner

*Primary Examiner* — Hongmin Fan

(74) *Attorney, Agent, or Firm* — Anthony D. Pellegrini

(57) ABSTRACT

A device to be used with a walker, with one component of the device attached to the walker and another component of the device worn by the user, whereby the device signals the user of the walker to use the walker by providing an alert whenever the user moves more than a predetermined distance from the walker, as determined by the distance between the two components of the device which wirelessly communicate with each other.

46 Claims, 6 Drawing Sheets

WALKER ALERT DEVICE

BACKGROUND OF THE INVENTION

Technical Field

The present invention relates generally to the field of medical devices. More particularly, the present invention is directed to an electronic device to be used with a walker to encourage the user of the walker to use the walker, by providing an alert whenever the user moves more than a predetermined distance from the walker.

Description of Prior Art

Walkers are well-known medical devices designed to assist users with locomotion. A walker typically consists of a rigid frame having a forward pair of legs, a rear pair of legs, and a handle means located at the upper portion by which the user grasps the walker. Other configurations are also known, such as walkers having one or more pairs of wheels to assist with movement of the walker. All such configurations are contemplated for use with the present invention. To use the walker, the user grasps the walker by the handle means, lifts the walker (or a portion of the walker) by the handle means, and places the walker some short distance in front of the user. The user then moves towards the walker, while holding onto the handle means for stability and support. This sequence may be repeated as often as desired. Because the walker provides a stabile structure onto which the user may lean, the user's balance is improved. In addition, a portion of the user's weight is distributed from the legs to the arms. As such, a walker greatly improves a user's ability to move about if the user has balance issues or has diminished leg strength.

Notwithstanding the benefits provided by a walker, many users who should use a walker occasionally fail to do so. This is typically through inadvertence; the majority of walker users are the elderly, who may have difficulty with short term memory or who may be easily distracted. Some users may not like the idea of having to use an assistive device, or may feel the walker is awkward to use. There is thus a common phenomenon whereby a user who has used a walker to move to a chair or a couch or some other sitting location will then arise from that location and proceed to walk away without first grasping the walker. The further the user moves away from the walker, the more likely the user will be unable to use the walker to prevent a fall in the event of a loss of balance or strength. Health care workers report significant numbers of injuries to users resulting from their ambulating away from walkers and then falling.

Various innovations have been made to improve the use of walkers, though none address the above problem. For example, U.S. Pat. No. 8,453,662 to Trout, for "Assistive walker apparatus" (Jun. 4, 2013), uses a walker module attached to a walker, a sensor module, software for interpreting data collected by the sensor and provided to the walker module, and a signaling means. The sensors comprise an infrared means (commonly known as an "electric eye") projecting a beam laterally across the rear legs of the walker. The purpose of the device is to determine whether the user is using the walker properly, i.e., moving it forward fast enough for therapeutic purposes. Thus, whenever the user, after positioning the walker ahead, walks up to the walker, the user breaks the infrared beam of the electric eye, signaling an "at rest" position of the user. When the walker is then moved ahead again, the beam is broken a second time, resetting and restarting a timer. If the user does not break the beam by moving back to an at rest position within a preset period of time, the signaling device will sound, reminding the user to continue walking at a faster pace.

Another patent, U.S. Pat. No. 8,810,407 to Nolan, et al., for "Walker with illumination, location, positioning, tactile and/or sensor capabilities" (Aug. 19, 2014), discloses a walker having a sensor module and a light source. The device also comprises a collision warning system having a collision avoidance sensor. This may be a radar-based system. There is also disclosed a tactile emitter (a "Braille unit") on the handle of the walker, coupled with a GPS system. The light source of primarily is used to illuminate the path of the user. The sensor module is used to locate the walker when it is in a dark place, or when the user has poor eyesight; the sensor receives input from the user and illuminates the light source (the signal may be auditory, like the "Clapper"™ device for turning lights on and off). The GPS is used to provide location information of the walker.

Another patent, U.S. Pat. No. 7,654,275 to Ewell, et al., for "Safety cane" (Feb. 2, 2010), discloses a cane that, among other things, has a high-decibel alarm that sounds if the user becomes separated from the cane. It also has a GPS for navigation purposes or to locate the user if lost. The functionality of alerting the user to being separated from the cane is accomplished by looping a string around the user's wrist; if the user drops the cane, the string triggers the alarm. While the basic principle of the present device is disclosed in Ewell, et al, its implementation does not easily lend itself to a walker, primarily because the use of a string to determine movement away from the walker presents a risk of entanglement and thus a safety hazard.

None of the foregoing art solves the problem of alerting a user to use a walker when the user moves away from the walker. There is thus a need for a device to be used with a walker which alerts the user to use the walker if the user is attempting to move about without using the walker.

It is therefore an object of the present invention to provide a device to be used with a walker that alerts a user to use the walker.

It is another object of the present invention to provide a device to be used with a walker that comprises a walker-based module and a user-based module, in wireless communication with each other, which in combination alert a user to use the walker.

It is yet another object of the present invention to provide a device to be used with a walker that uses GPS technology to determine the distance between the walker-based module and the user-based module, whereby an alert is generated when the distance between the modules exceeds a predetermined amount.

It is yet another object of the present invention to provide a device to be used with a walker that comprises a proximity sensor to determine the distance between the walker-based module and the user-based module, whereby an alert is generated when the distance between the modules exceeds a predetermined amount.

It is yet another object of the present invention to provide a device to be used with a walker that comprises a motion detector to determine whether a user has risen from a sitting or prone position to a standing position, in which case an alert is generated.

It is yet another object of the present invention to provide a device to be used with a walker wherein the user module is worn by the user.

It is yet another object of the present invention to provide a device to be used with a walker that comprises a wearable module in the form of a bracelet or a necklace to be worn by the user.

It is yet another object of the present invention to provide a device to be used with a walker that comprises a walker-based module which is removably attachable to the walker.

It is yet another object of the present invention to provide a device to be used with a walker that generates one or more human perceptible indications to alert a user to use the walker.

It is yet another object of the present invention to provide a device to be used with a walker whereby the walker-based module generates one or more human perceptible indications to alert a user to use the walker.

It is yet another object of the present invention to provide a device to be used with a walker whereby the user-based module generates one or more human perceptible indications to alert a user to use the walker.

Various other objects, features and attendant advantages of the present invention will become obvious to the reader and become fully appreciated as the same becomes better understood when considered in conjunction with the accompanying drawings. It is intended that these objects and advantages are within the scope of the present invention. To the accomplishment of the above and related objects, this invention may be embodied in the form illustrated in the accompanying drawings. Attention being called to the fact, however, that the drawings are illustrative only, and that changes may be made in the specific construction illustrated and described within the scope of this application.

SUMMARY OF THE INVENTION

The present invention is a device to be used with a walker which alerts the user if the user is attempting to move about without using the walker. This is accomplished by providing a walker module that is associated with the walker and a user module that is associated with the user. The walker module and the user module are in wireless communication with each other. Using GPS technology and/or one or more proximity sensors, the device generates a human perceptible indication, such as a tone, a light, a recorded statement, etc., whenever the distance between the walker module and the user module exceeds a predetermined distance. Thus, a user who moves too far away from his or her walker is alerted to return to the walker.

In one embodiment, the user module is a necklace or a bracelet, to be worn by the user. In another embodiment the user module is attachable to the user's clothing, for example, by a pin or a Velcro® fastener. In yet another embodiment the user module fits into the user's pocket. The walker module is attached to the walker, either permanently or removably, for example, with Velcro® straps or by a bracket attached to the walker.

In another embodiment the user module of the device optionally comprises a motion detector, to determine whether the user has changed position from a sitting or prone position to a standing position. In such case the device generates a human perceptible indication to alert the user to use the walker. In this embodiment, the human perceptible indication may be of a less urgent form than the human perceptible indication generated when the user is too far from the walker; for example, a single tone could sound when the user stands, while a series of repeated tones could sound if the user wanders from the walker.

Other features and advantages of the present invention are described below.

DETAILED DESCRIPTION OF THE INVENTION

Figure 1:
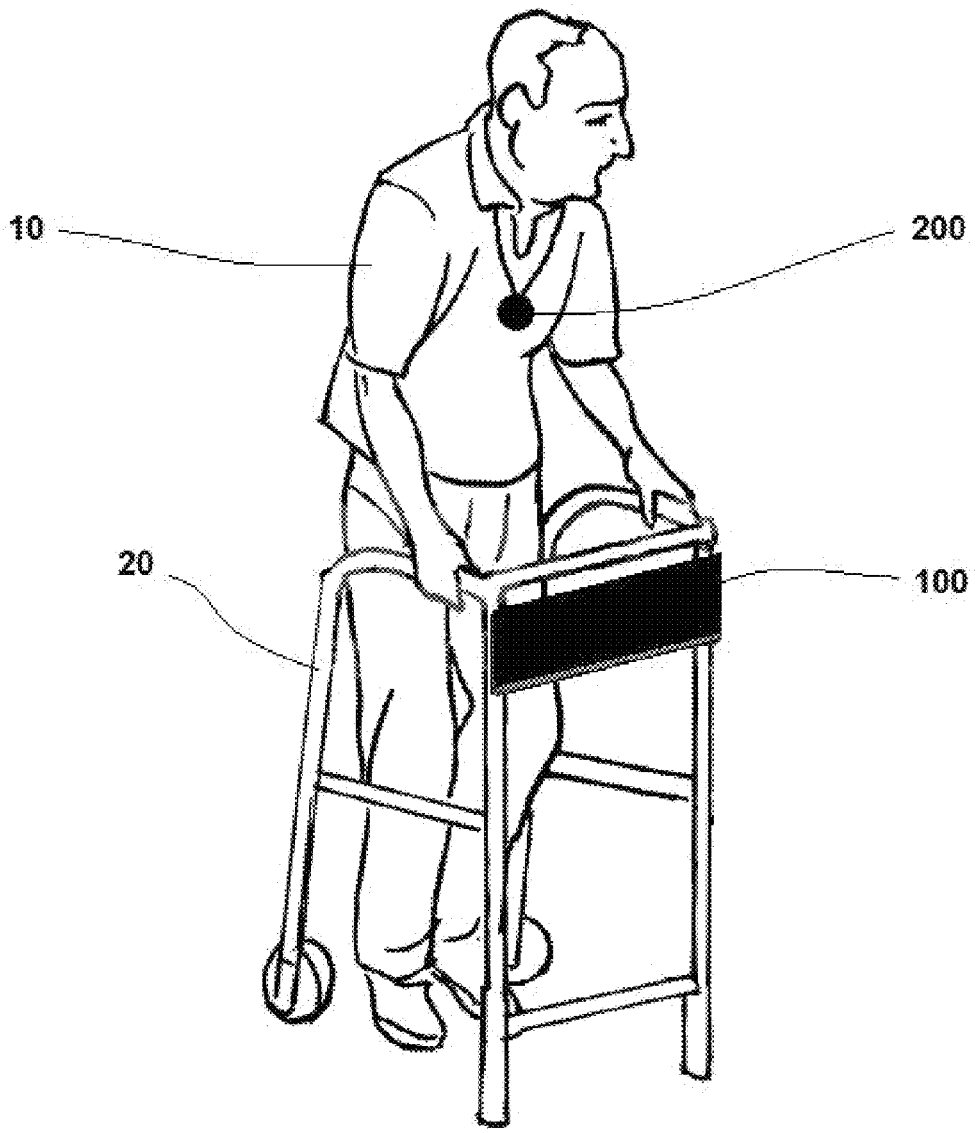
FIG. 1 depicts a user using a walker, using one embodiment of the present invention.
Figure 2:
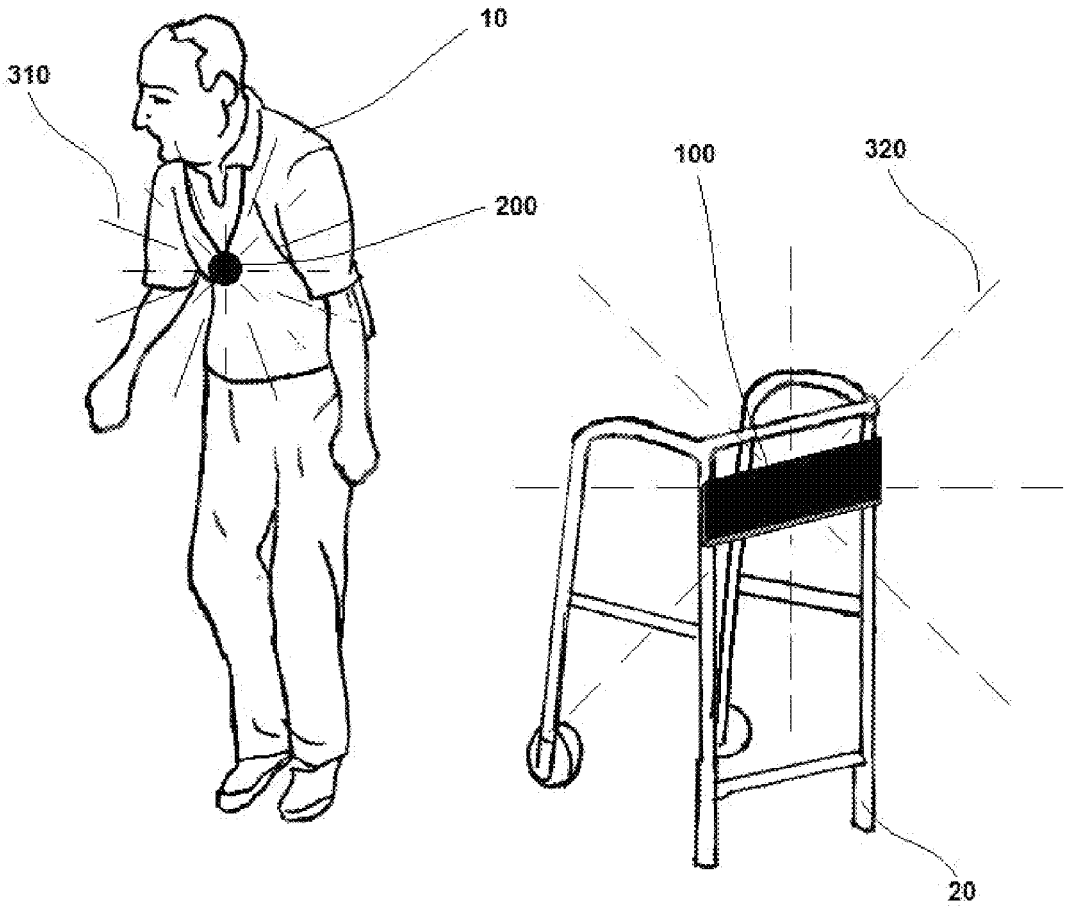
FIG. 2 depicts the embodiment of the present invention shown in FIG. 1, where the user has moved away from the walker, causing the user module to emit a first human perceptible indication (an audible warning) and the walker module to emit a second human perceptible indication (a flashing light to indicate the location of the walker).

The present invention discloses a device comprising a walker module 100 and a user module 200. The walker module 100 and the user module 200 are independent components of the device not physically connected to each other, but they are in wireless communication with each other. The walker module 100 is attached to a walker 20, and the user module 200 is kept on the person of a user 10 of the walker 20. See FIG. 1. The device determines a first status, with the first status having an active state and an inactive state. The first status is active when the distance between the walker module 100 and the user module 200 is greater than a predetermined threshold distance. The first status is inactive when the distance between the walker module 100 and the user module 200 is less than or equal to the predetermined threshold distance. The predetermined threshold distance is the maximum distance deemed safe for the user 10 to be from the walker 20, typically within the range of one to three feet. The device is capable of generating a first human perceptible indication 310 when the first status is active. The first human perceptible indication 310 generated by the first human perceptible indication generating means 312 of the device may be one or more of the following: a vibration, a constant light, a flashing light, a continuous tone, a repeating tone, a musical tone, a prerecorded spoken word, or a prerecorded spoken phrase, either emitted serially or in combination (for example, a tone followed by a constant light, or a light flashing while a spoken phrase is played). Thus, when a user 10 having the user module 200 on his or her person moves more than a step or so away from the walker 20 having the walker module 100 attached thereto, the device determines the first status to be active and generates the first human perceptible indication 310, say, a warning tone, to alert the user 10 to move back to the walker 20. See FIG. 2.

Figure 3:
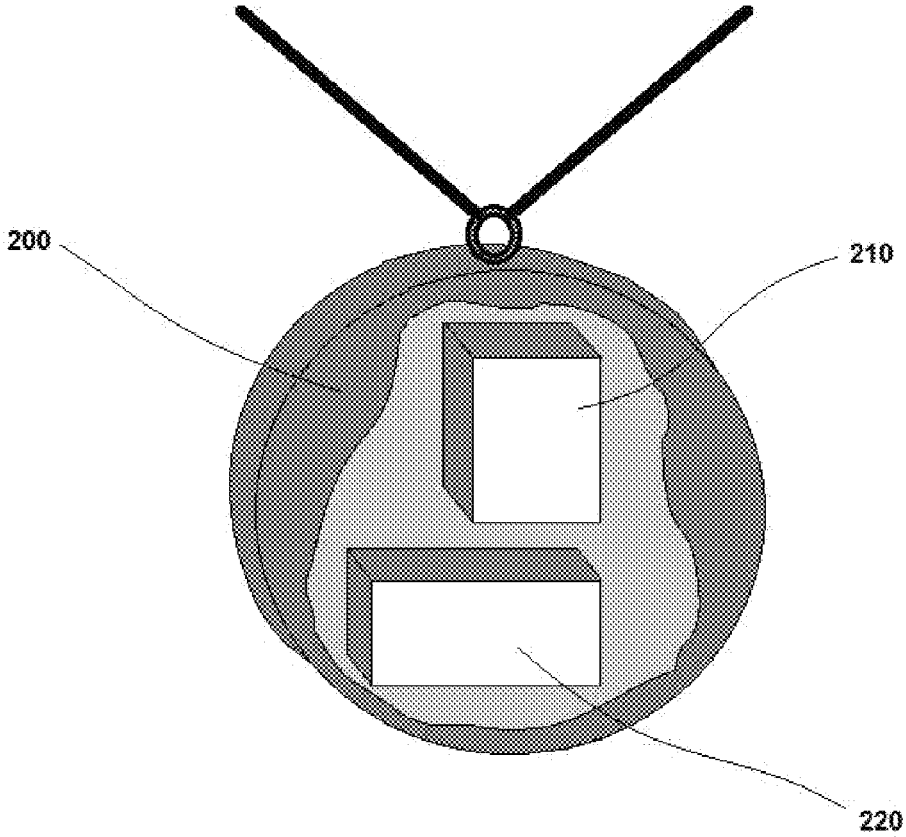
FIG. 3 is a stylized depiction of one embodiment of the user module of the present invention, cut away to show the use of a receiver and a transmitter for communications with the walker module.
Figure 4:
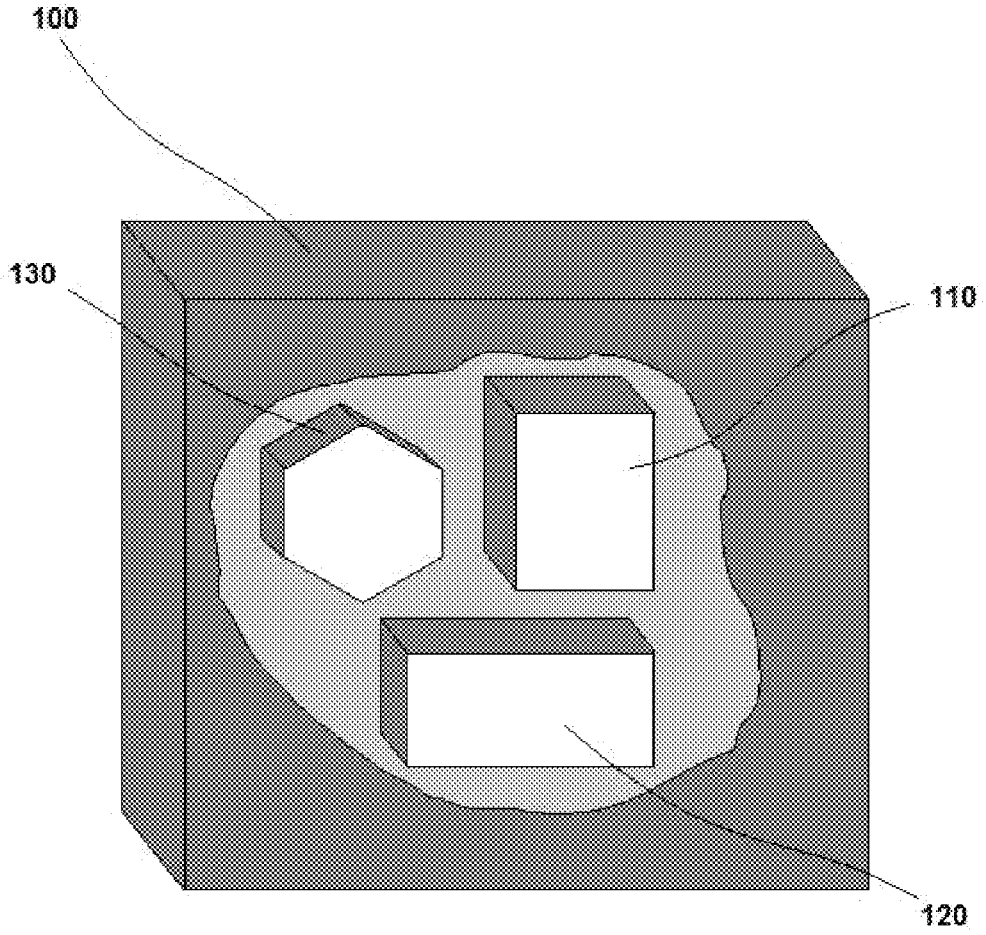
FIG. 4 is a stylized depiction of an embodiment of the walker module of the present invention, cut away to show the use of a GPS receiver for obtaining information on the physical location of the walker module, as well as a receiver and a transmitter for communications with the user module.

Communication between the walker module 100 and the user module 200 may be accomplished using radio technology, Bluetooth™ technology, infrared technology, or any other suitable technology that permits wireless communications between the walker module 100 and the user module 200. See FIGS. 3 and 4. In one embodiment, the user module 200 comprises a transmitter 220 and the walker module 100 comprises a receiver 110, with communications going from the user module 200 to the walker module 100. In another embodiment, the walker module 100 comprises a transmitter 120 and the user module 200 comprises a receiver 210, with communications going from the walker module 100 to the user module 200. In yet another, preferred embodiment, the user module 200 comprises both a transmitter 220 and a receiver 210 and the walker module 100 comprises both a transmitter 120 and a receiver 110, with communications going between the user module 200 and the walker module 100. Communications between the walker module 100 and the user module 200 may be managed by customer computer software. Each module may contain an integrated circuit board, a logic processor, memory modules, and the like, as is well known in the art.

Figure 6:
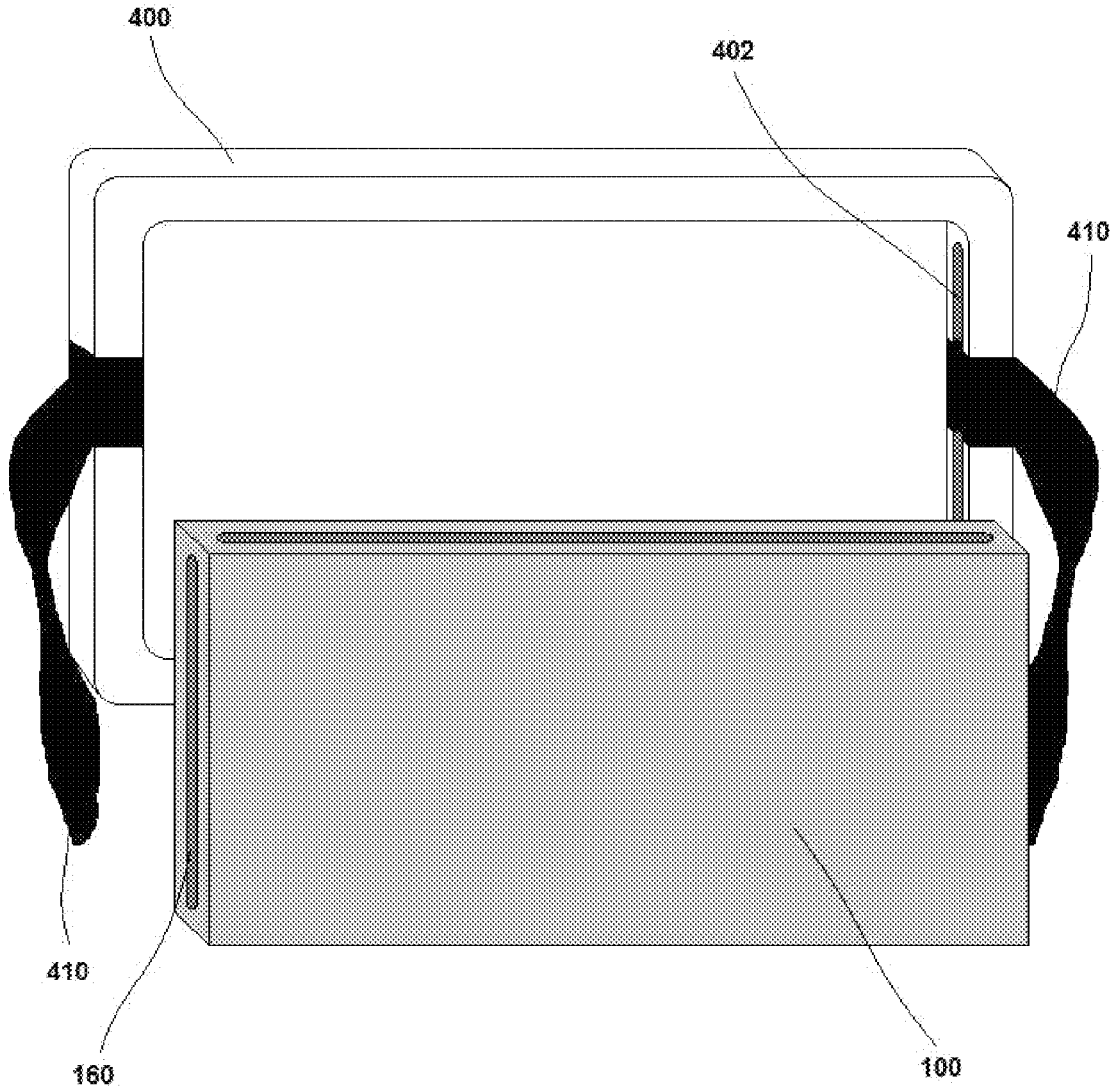
FIG. 6 is a depiction of an embodiment of the present invention where a bracket is used to removably secure the walker module to the walker, where the walker module snaps into the bracket and the bracket is secured to the walker by the use of straps having hook and loop fastening means.

The walker module 100 is configured to be easily kept with the walker 20. In one embodiment it is configured to be permanently attached to the walker 20, by the use of screws, straps, adhesives, or other fasteners. In the preferred embodiments, the walker module 100 is configured to be removably attached to the walker 20. This allows the walker module 100 to be moved from one walker 20 to another, if the walker 20 needs to be replaced, as well as allowing the walker module 100 to be easily removed from the walker 20 for servicing. In one embodiment, the walker module 100 is removably attached to the walker 20 by the use of a hook and loop fastener, e.g., a Velcro™ strap. In another embodiment, the walker module 100 may have an integrated clamp that is configured to be attached to the walker 20. Other embodiments are also contemplated. In the preferred embodiment, a bracket 400 is attached to the walker 20, and the walker module 100 is attached to the bracket 400. The bracket 400 may be permanently attached to the walker 20 by the use of screws, straps, adhesives, or other fasteners. In the preferred embodiments, the bracket 400 is configured to be removably attached to the walker 20. In one embodiment, the bracket 400 is removably attached to the walker 20 by the use of a hook and loop fastener 410, e.g., a Velcro™ strap. In another embodiment, the bracket 400 may have an integrated clamp that is configured to be attached to the walker 20. The walker module 100 may be attached to the bracket 400 by any suitable means. In the most preferred embodiment, the walker module 100 snaps onto the bracket 400, with the bracket 400 having peripheral protuberances 402 and the walker module 100 having peripheral channels 160, whereby the protuberances 402 fit into the channels 160 and hold the walker module 100 securely to the bracket 400. See FIG. 6.

The user module 200 is configured to be easily kept on the person of the user 10. This can be achieved by the user module 200 being configured to be worn by the user 10, or to be carried by the user 10, or to be attached to an article of clothing worn by the user 10. If the user module 200 is to be worn, it may be configured as a necklace, see FIGS. 1 and 2, a bracelet, a belt, an arm band, or any other suitable item. If it is configured to be carried by the user 10, for example, in a pocket, the first human perceptible indication 310 should be one of the audible variants. If the user module 200 is to be attached to an article of clothing, it could be configured as a broach or otherwise be pinned to a shirt, blouse, dress, sweater, or the like, or clamped thereon, or attached using a hook and loop fastener, such as Velcro™. Other means for keeping the user module 200 on the person of the user 10 are also contemplated by the present invention.

Both the walker module 100 and the user module 200 are powered. In one embodiment the walker module 100 is powered by one or more disposable batteries. In another embodiment the walker module 100 is powered by one or more rechargeable batteries. Likewise, in another embodiment the user module 200 is powered by one or more disposable batteries, and in yet another embodiment the user module 200 is powered by one or more rechargeable batteries. Where the walker module 100 and the user module 200 use batteries for a power source, each may also comprise a battery level meter, so that the user 10 will know it is time to recharge or replace the batteries. Other indicators may also be present on one or both of the modules, such as power on/power off indicators, signal strength indicators, and the like.

The first human perceptible indication 310 may be generated by the walker module 100, the user module 200, or both. In one embodiment, the determination of whether the first status is active is made by the walker module 100 and the walker module 100 generates the first human perceptible indication 310. In another embodiment, the determination of whether the first status is active is made by the walker module 100, and if the first status is determined to be active, the walker module 100 wirelessly sends an alert signal to the user module 200, which in turn generates the first human perceptible indication 310 upon receipt of the alert signal. In another embodiment, the determination of whether the first status is active is made by the user module 200 and the user module 200 generates the first human perceptible indication 310. In another embodiment, the determination of whether the first status is active is made by the user module 200, and if the first status is determined to be active, the user module 200 wirelessly sends an alert signal to the walker module 100, which in turn generates the first human perceptible indication 310 upon receipt of the alert signal. In yet another embodiment, both the walker module 100 and the user module 200 generate the first human perceptible indication 310, whereby one module sends an alert signal to the other module when the first status is active.

In another embodiment, the walker module 100 is configured to generate a second human perceptible indication 320 when the first status is active. The second human perceptible indication 320 generated by the walker module 100 may be one or more of the following: a vibration, a constant light, a flashing light, a continuous tone, a repeating tone, a musical tone, a prerecorded spoken word, or a prerecorded spoken phrase, either emitted serially or in combination. The second human perceptible indication 320 generated by the walker module 100 is intended to indicate the location of the walker 20 to the user 10. Thus, while the first human perceptible indication 310 may be the spoken recorded phrase "you are too far away from your walker" generated by the user module 200, the second human perceptible indication 320 may be a flashing light and/or a chime generated by the walker module 100, indicating the location of the walker 20.

The device of the present invention may determine the first status in any number of ways. In one embodiment, global positioning system (GPS) technology is used. See FIG. 4. In this embodiment, the walker module 100 comprises a first GPS receiver 130 capable of determining the physical location of the walker module 100. The user module 200 has a second GPS receiver capable of determining the physical location of the user module 200. The user module 200 further is configured to wirelessly send information to the walker module 100 regarding the physical location of the user module 200 as determined by the second GPS receiver. The walker module 100 determines the first status by comparing the physical location of the walker module 100 as determined by the first GPS receiver 130 to the physical location of the user module 200 as determined by the second GPS receiver. The first status is deemed active when the physical location of the walker module 100 is a greater distance from the physical location of the user module 200 than the predetermined threshold distance.

In other embodiments, the first status is determined by a proximity sensor. In these embodiments the proximity sensor has a first component 140 and a second component 240, with the first component 140 located in the walker module 100 and the second component 240 located in the user module 200. In one such embodiment, the second component 240 of the proximity sensor emits a wireless signal. The first component 140 of the proximity sensor is configured to detect that wireless signal and to measure the strength of that wireless signal. The strength of the wireless signal decreases in a known manner as the distance between the first and second components 140,240 of the proximity sensor increases. The walker module 100 determines the first status is inactive when the strength of the wireless signal is above a predetermined threshold, and determines the first status is active when the strength of the wireless signal falls below the predetermined threshold. The threshold is determined by correlating the strength over distance of the signal, such that when the distance between the first component 140 and the second component 240 of the proximity sensor is greater than what is deemed to be safe for the user 10, the corresponding strength of the wireless signal is set as the threshold. This may be viewed as the user module 200 sending an "all okay" signal to the walker module 100; as long as that signal is strong enough, the user 10 is deemed near enough to the walker 20 and the first status remains inactive. The signal may be sent from the second component 240 of the proximity sensor continuously, or it may be sent periodically.

Figure 5A:
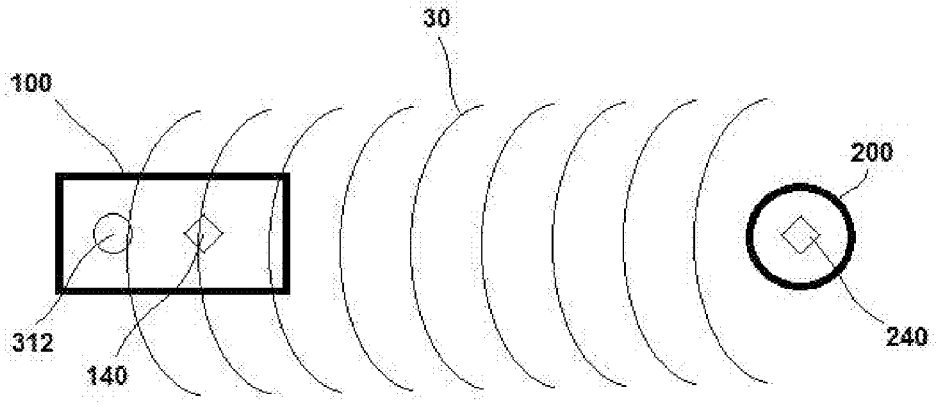
FIG. 5A is a stylized depiction of one embodiment of the present invention whereby a proximity sensor is used to determine the distance between the user module and the walker module, with the second component of the proximity sensor sending a weak signal from the user module, where it is received by the first component of the proximity sensor located in the walker module.
Figure 5B:
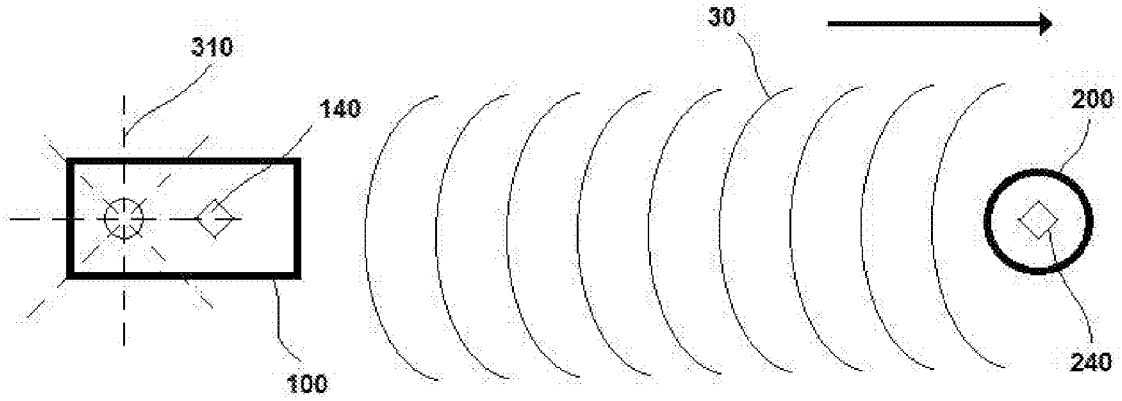
FIG. 5B is a stylized depiction of the configuration shown in FIG. 5A, with the second component of the proximity sensor sending a weak signal from the user module, but in this depiction the signal is not received by the first component of the proximity sensor located in the walker module because the user module is too far away from the walker module, whereupon the walker module emits a first human perceptible indication, in this example, a flashing light.

In another such embodiment, the second component of the proximity sensor emits a relatively weak wireless signal 30. The first component 140 of the proximity sensor is configured to detect that wireless signal 30 only when the first and second components 140,240 of the proximity sensor are sufficiently near each other. See FIG. 5A. The walker module 100 determines the first status is inactive when the wireless signal 30 is detected by the first component 140, and determines the first status is active when the first component 140 fails to detect the wireless signal 30. See FIG. 5B. This may be viewed as the user module 200 sending an "all okay" signal to the walker module 100; as long as the walker module 100 receives this signal 30, the user 10 is deemed near enough to the walker 20 and the first status remains inactive. The signal 30 may be sent from the second component 240 of the proximity sensor continuously, or it may be sent periodically.

In yet another such embodiment, the first component 140 of the proximity sensor emits a relatively weak wireless signal. The second component 240 of the proximity sensor is configured to detect that wireless signal and to measure the strength of that wireless signal. The strength of the wireless signal decreases in a known manner as the distance between the first and second components 140,240 of the proximity sensor increases. The user module 200 determines the first status is inactive when the strength of the wireless signal is above a predetermined threshold, and determines the first status is active when the strength of the wireless signal falls below the predetermined threshold. When the user module 200 determines the first status to be active, the user module 200 wirelessly sends a warning signal to the walker module 100. Upon receipt of the warning signal from the user module 200, the walker module 100 determines the first status to be active. This may be viewed as the user module 200 sending a "something's wrong" signal to the walker module 100; as long as the walker module 100 does not receive such a signal, the user 10 is deemed near enough to the walker 20 and the first status remains inactive. The signal may be sent from the first component 140 of the proximity sensor continuously, or it may be sent periodically. This configuration requires the second component 240 to transmit a signal only when the two components 140,240 of the proximity sensor are too far apart. This may therefore be preferred if battery life of the user module 200 is of concern (the user module 200 is typically configured to be smaller than the walker module 100, as it is worn by the user 10, and so may use smaller batteries).

In yet another such embodiment, the first component 140 of the proximity sensor emits a relatively weak wireless signal. The second component 240 of the proximity sensor is configured to detect that wireless signal only when the first and second components 140,240 of the proximity sensor are sufficiently near each other. When the second component 240 of the proximity sensor fails to detect the signal, the user module 200 wirelessly sends a warning signal to the walker module 100. Upon receipt of the warning signal from the user module 200, the walker module 100 determines the first status to be active. This may be viewed as the user module 200 sending a "something's wrong" signal to the walker module 100; as long as the walker module 100 does not receive such a signal, the user 10 is deemed near enough to the walker 20 and the first status remains inactive. The signal may be sent from the second component 240 of the proximity sensor continuously, or it may be sent periodically. This configuration also requires the second component 240 to transmit a signal only when the two components 140,240 of the proximity sensor are too far apart.

In yet another such embodiment, the first component 140 of the proximity sensor emits a relatively weak wireless signal. The second component 240 of the proximity sensor is configured to detect that wireless signal only when the first and second components 140,240 of the proximity sensor are sufficiently near each other. When the second component 240 of the proximity sensor detects the signal, the user module 200 wirelessly sends a confirmation signal to the walker module 100. Upon receipt of the confirmation signal from the user module 200, the walker module 100 determines the first status to be inactive. If no confirmation signal is received by the walker module 100, the first status is determined to be active. This may be viewed as the user module 200 sending an "all okay" signal to the walker module 100; as long as the walker module 100 does receives such a signal, the user 10 is deemed near enough to the walker 20 and the first status remains inactive. The signal may be sent from the second component 240 of the proximity sensor continuously, or it may be sent periodically.

In yet another such embodiment, the first component 140 of the proximity sensor emits a relatively weak wireless signal. The second component 240 of the proximity sensor is configured to detect that wireless signal only when the first and second components 140,240 of the proximity signal are sufficiently near each other. When second component 240 fails to detect the wireless signal, the user module 200 generates the first human perceptible indication 310. In this configuration the user module 200 determines whether the first status is active.

In yet another such embodiment, the first component 140 of the proximity sensor wirelessly sends a query signal to the second component 240. The second component 240 responds to the receipt of the query signal by wirelessly sending a return signal to the first component 140. The walker module 100 determines the first status based on the total time required for the first component 140 to send the query signal to the second component 240 and to receive the return signal from the second component 240. The first status is active when the total time required for the first component 140 to send the query signal to the second component 240 and to receive the return signal from the second component 240 exceeds a predetermined threshold time. The threshold is determined by correlating time over distance of the signal, such that when the distance between the first component 140 and the second component 240 of the proximity sensor is greater than what is deemed to be safe for the user 10, the corresponding time for the wireless signal to make the round trip is set as the threshold. This may be viewed as the walker module 100 sending out an "all okay" round trip signal; as long as that signal returns quickly enough, the user 10 is deemed near enough to the walker 20 and the first status remains inactive. The signal may be sent from the second component 240 of the proximity sensor continuously, or it may be sent periodically.

In another embodiment, the device of the present invention determines a second status, with the second status having an active state and an inactive state. The second status is active when the user 10 moves from a sitting or prone position to a standing position. The second status is inactive when the user 10 maintains a sitting, prone, or standing position. In this embodiment, the device generates a third human perceptible indication when the second status is active. The third human perceptible indication may be one or more of the following: a vibration, a constant light, a flashing light, a continuous tone, a repeating tone, a musical tone, a prerecorded spoken word, or a prerecorded spoken phrase, either emitted serially or in combination. The third human perceptible indication may be generated by either the user module 200 or the walker module 100 or both. The third human perceptible indication is intended to indicate to the user 10 that the user 10 should be getting ready to use the walker 20. Moreover, the first human perceptible indication 310 generated by the device as a result of an active first status is intended to convey a greater sense of urgency than the third human perceptible indication generated by the user module 200 as a result of an active second status. That is because a user 10 merely standing up (triggering the second status) may not have moved dangerously away from the walker 20, and so needs only a gentle reminder to use the walker 20, while a user 10 who has moved away from the walker 20 (triggering the first status) needs to be more urgently reminded to return to the walker 20. So, for example, the third human perceptible indication may be the spoken recorded phrase "don't forget to use your walker", while the first human perceptible indication 310 may be the spoken recorded phrase "warning, you are too far away from your walker".

The second status may be determined by use of a motion sensor integrated with the user module 200. In this embodiment, the third human perceptible indication is typically generated by the user module 200. If the third human perceptible indication is generated by the walker module 100, the user module 200 is configured to send a signal to the walker module 100, which in turn generates the third human perceptible indication upon receipt of that signal. In the preferred embodiment the motion sensor has at least one gyroscope and at least one accelerometer. An example of a commercially available motion sensor is the Invensense 6 Axis Intelligent Sensor™, which combines a 3-axis gyroscope and a 3-axis accelerometer.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

I claim:

1. A device for use with a walker, said device comprising a walker module and a user module, with the walker module being attached to the walker, and the user module being suitably configured to be kept on the person of a user of the walker, wherein the device is capable of determining a first status, with the first status being active when a distance between the walker module and the user module is greater than a predetermined threshold distance, and the first status being inactive when the distance between the walker module and the user module is equal to or less than the predetermined threshold distance, and the device is capable of generating a first human perceptible indication when the first status is active;

wherein the first human perceptible indication generated by the device is selected from the group consisting of: a vibration, a constant light, a flashing light, a continuous tone, a repeating tone, a musical tone, a spoken word, and a spoken phrase.

2. The device of claim 1 wherein the first human perceptible indication is generated by the walker module.

3. The device of claim 1 wherein the device determines the first status by the use of a proximity sensor.

4. The device of claim 3 wherein the proximity sensor has a first component and a second component, with the first component located in the walker module and the second component located in the user module, whereby the second component of the proximity sensor emits a relatively weak wireless signal and the first component of the proximity sensor is configured to detect said weak wireless signal only when the first and second components of the proximity sensor are sufficiently near each other, with the walker module determining the first status based on whether said weak wireless signal is detected by the first component, with the first status being active when the first component fails to detect said weak wireless signal.

5. The device of claim 3 wherein the proximity sensor has a first component and a second component, with the first component located in the walker module and the second component located in the user module, whereby the first component of the proximity sensor emits a relatively weak wireless signal and the second component of the proximity sensor is configured to detect said weak wireless signal only when the first and second components of the proximity sensor are sufficiently near each other, with the user module determining the first status is active when the second component of the proximity sensor cannot detect said weak wireless signal, and with the user module being capable of generating the first human perceptible indication when the first status is active.

6. The device of claim 3 wherein the proximity sensor has a first component and a second component, with the first component located in the walker module and the second component located in the user module, whereby the first component of the proximity sensor emits a relatively weak wireless signal and the second component of the proximity sensor is configured to detect said weak wireless signal only when the first and second components of the proximity sensor are sufficiently near each other, with the user module being capable of wirelessly sending a warning signal to the walker module when the second component fails to detect the weak wireless signal emitted from the first component, and with the walker module determining the first status to be active when the walker module receives the warning signal sent by the user module.

7. The device of claim 3 wherein the proximity sensor has a first component and a second component, with the first component located in the walker module and the second component located in the user module, whereby the first component of the proximity sensor emits a relatively weak wireless signal and the second component of the proximity sensor is configured to detect said weak wireless signal only when the first and second components of the proximity sensor are sufficiently near each other, with the user module being capable of wirelessly sending a confirmation signal to the walker module when the second component detects the weak wireless signal emitted from the first component, and with the walker module determining the first status to be active when the walker module fails to receive the confirmation signal.

8. The device of claim 3 wherein the proximity sensor has a first component and a second component, with the first component located in the walker module and the second component located in the user module, whereby the first component wirelessly sends a query signal to the second component which responds by wirelessly sending a return signal to the first component, with the walker module determining the first status based on the total time required for the first component to send the query signal to the second component and to receive the return signal from the second component, with the first status being active when the total time required for the first component to send the query signal to the second component and to receive the return signal from the second component exceeds a predetermined threshold time.

9. The device of claim 3 wherein the proximity sensor has a first component and a second component, with the first component located in the walker module and the second component located in the user module, whereby the second component of the proximity sensor emits a wireless signal and the first component of the proximity sensor is configured to detect said wireless signal and to measure the strength of said wireless signal, whereby the strength of the wireless signal decreases in a known manner as the distance between the first and second components increases, with the walker module determining the first status based on the strength of said wireless signal, with the first status being active when the strength of said wireless signal falls below a predetermined threshold.

10. The device of claim 3 wherein the proximity sensor has a first component and a second component, with the first component located in the walker module and the second component located in the user module, whereby the first component of the proximity sensor emits a wireless signal and the second component of the proximity sensor is configured to detect said wireless signal and to measure the strength of said wireless signal, whereby the strength of the wireless signal decreases in a known manner as the distance between the first and second components increases, with the user module determining the first status based on the strength of said wireless signal, with the first status being active when the strength of said wireless signal falls below a predetermined threshold.

11. The device of claim 1 wherein the walker module is capable of wirelessly sending an alert signal to the user module when the first status is active, and the user module is capable of receiving the alert signal from the walker module and generating the first human perceptible indication upon receipt of the alert signal from the walker module.

12. The device of claim 1 wherein the user module is suitably configured to be worn by the user of the walker.

13. The device of claim 12 wherein the user module is configured as a wearable article selected from the group consisting of: a necklace, a bracelet, a belt, and an arm band.

14. The device of claim 1 wherein the user module is suitably configured to be carried by the user of the walker.

15. The device of claim 1 wherein the user module is suitably configured to be attached to an article of clothing worn by the user.

16. The device of claim 15 wherein the user module is suitably configured as an object to be attached to an article of clothing worn by the user, said object having an attachment mechanism selected from the group consisting of: a pin, a clamp, and a hook and loop fastener.

17. The device of claim 1 wherein the walker module is further capable of generating a second human perceptible indication upon the first status being active.

18. The device of claim 17 wherein the second human perceptible indication generated by the walker module is selected from the group consisting of: a vibration, a constant light, a flashing light, a continuous tone, a repeating tone, a musical tone, a spoken word, and a spoken phrase.

19. The device of claim 17 wherein the user module is capable of determining a second status, with the second status being active when the user moves from a sitting or prone position to a standing position, and the second status being inactive when the user maintains a sitting, prone, or standing position, with the user module further being capable of generating a third human perceptible indication when the second status is active, whereby the second human perceptible indication generated by the walker module is selected from the group consisting of: a vibration, a constant light, a flashing light, a continuous tone, a repeating tone, a musical tone, a spoken word, and a spoken phrase, and the third human perceptible indication generated by the user module is selected from the group consisting of: a vibration, a constant light, a flashing light, a continuous tone, a repeating tone, a musical tone, a spoken word, and a spoken phrase.

20. The device of claim 1 wherein the walker module is removably attached to the walker.

21. The device of claim 20 wherein the walker module is removably attached to the walker by the use of a hook and loop fastener.

22. The device of claim 1 further comprising a bracket, wherein the bracket is removably attached to the walker and the walker module is attached to the bracket.

23. The device of claim 22 wherein the bracket is removably attached to the walker by the use of a hook and loop fastener.

24. A device for use with a walker, said device comprising a walker module and a user module, with the walker module being attached to the walker, and the user module being suitably configured to be kept on the person of a user of the walker, wherein the device is capable of determining a first status, with the first status being active when a distance between the walker module and the user module is greater than a predetermined threshold distance, and the first status being inactive when the distance between the walker module and the user module is equal to or less than the predetermined threshold distance, and the device is capable of generating a first human perceptible indication when the first status is active, wherein the first human perceptible indication is generated by the user module.

25. The device of claim 24 wherein the walker module is capable of wirelessly sending an alert signal to the user module when the first status is active, and the user module is capable of receiving the alert signal from the walker module and generating the first human perceptible indication upon receipt of the alert signal from the walker module.

26. The device of claim 24 wherein the first human perceptible indication generated by the device is selected from the group consisting of: a vibration, a constant light, a flashing light, a continuous tone, a repeating tone, a musical tone, a spoken word, and a spoken phrase.

27. The device of claim 24 wherein the user module is suitably configured to be worn by the user of the walker.

28. The device of claim 27 wherein the user module is configured as a wearable article selected from the group consisting of: a necklace, a bracelet, a belt, and an arm band.

29. The device of claim 24 wherein the user module is suitably configured to be carried by the user of the walker.

30. The device of claim 24 wherein the user module is suitably configured to be attached to an article of clothing worn by the user.

31. The device of claim 30 wherein the user module is suitably configured as an object to be attached to an article of clothing worn by the user, said object having an attachment mechanism selected from the group consisting of: a pin, a clamp, and a hook and loop fastener.

32. The device of claim 24 wherein the walker module is further capable of generating a second human perceptible indication upon the first status being active.

33. The device of claim 32 wherein the second human perceptible indication generated by the walker module is selected from the group consisting of: a vibration, a constant light, a flashing light, a continuous tone, a repeating tone, a musical tone, a spoken word, and a spoken phrase.

34. The device of claim 32 wherein the user module is capable of determining a second status, with the second status being active when the user moves from a sitting or prone position to a standing position, and the second status being inactive when the user maintains a sitting, prone, or standing position, with the user module further being capable of generating a third human perceptible indication when the second status is active, whereby the first human perceptible indication generated by the device is selected from the group consisting of: a vibration, a constant light, a flashing light, a continuous tone, a repeating tone, a musical tone, a spoken word, and a spoken phrase, the second human perceptible indication generated by the walker module is selected from the group consisting of: a vibration, a constant light, a flashing light, a continuous tone, a repeating tone, a musical tone, a spoken word, and a spoken phrase, and the third human perceptible indication generated by the user module is selected from the group consisting of: a vibration, a constant light, a flashing light, a continuous tone, a repeating tone, a musical tone, a spoken word, and a spoken phrase.

35. The device of claim 24 wherein the walker module is removably attached to the walker.

36. The device of claim 35 wherein the walker module is removably attached to the walker by the use of a hook and loop fastener.

37. The device of claim 24 further comprising a bracket, wherein the bracket is removably attached to the walker and the walker module is attached to the bracket.

38. The device of claim 37 wherein the bracket is removably attached to the walker by the use of a hook and loop fastener.

39. A device for use with a walker, said device comprising a walker module and a user module, with the walker module being attached to the walker, and the user module being suitably configured to be kept on the person of a user of the walker, wherein the device is capable of determining a first status, with the first status being active when a distance between the walker module and the user module is greater than a predetermined threshold distance, and the first status being inactive when the distance between the walker module and the user module is equal to or less than the predetermined threshold distance, the device is capable of generating a first human perceptible indication when the first status is active, and the user module is capable of determining a second status, with the second status being active when the user moves from a sitting or prone position to a standing position, and the second status being inactive when the user maintains a sitting, prone, or standing position, with the device further being capable of generating a third human perceptible indication when the second status is active.

40. The device of claim 39 wherein the user module comprises a motion sensor having a gyroscope and an accelerometer, whereby the user module determines the second status by the use of the motion sensor.

41. The device of claim 39 wherein the third human perceptible indication is generated by the user module when the second status is active.

42. The device of claim 39 wherein the user module is capable of wirelessly sending an alert signal to the walker module when the second status is active, whereby the walker module is capable of generating the third human perceptible indication upon receipt of the alert signal from the user module.

43. The device of claim 39 wherein the third human perceptible indication generated by the device is selected from the group consisting of: a vibration, a constant light, a flashing light, a continuous tone, a repeating tone, a musical tone, a spoken word, and a spoken phrase.

44. The device of claim 39 wherein the third human perceptible indication generated by the device is a first spoken phrase and the first human perceptible indication generated by the device is a second spoken phrase, whereby the first spoken phrase alerts the user to use the walker and the second spoken phrase warns the user that the user has moved a dangerous distance away from the walker.

45. A device for use with a walker, said device comprising a walker module and a user module, with the walker module being attached to the walker, and the user module being suitably configured to be kept on the person of a user of the walker, wherein the device is capable of determining a first status, with the first status being active when a distance between the walker module and the user module is greater than a predetermined threshold distance, and the first status being inactive when the distance between the walker module and the user module is equal to or less than the predetermined threshold distance, the device is capable of generating a first human perceptible indication when the first status is active, and the walker module determines the first status by the use of GPS technology.

46. The device of claim 45 wherein the walker module has a first GPS receiver capable of determining the physical location of the walker module, and the user module has a second GPS receiver capable of determining the physical location of the user module, with the user module further configured to wirelessly send information to the walker module regarding the physical location of the user module as determined by the second GPS receiver, wherein the walker module determines the first status by comparing the physical location of the walker module as determined by the first GPS receiver to the physical location of the user module as determined by the second GPS receiver, whereby the first status is active when the physical location of the walker module as determined by the first GPS receiver is a greater distance from the physical location of the user module as determined by the second GPS receiver than the predetermined threshold distance.

* * * * *